United States Patent [19]

Watts

[11] 3,972,293

[45] Aug. 3, 1976

[54] SWITCH FOR A RAILROAD TRANSPORTATION SYSTEM EMPLOYING A ROTATING DRIVE SHAFT

[75] Inventor: Max Welton Watts, Tiger, Ga.

[73] Assignee: The Aid Corporation, Clayton, Ga.

[22] Filed: Mar. 17, 1975

[21] Appl. No.: 558,658

Related U.S. Application Data

[62] Division of Ser. No. 454,446, March 25, 1974, Pat. No. 3,897,734.

[52] U.S. Cl. ..... 104/130; 246/415 R

[51] Int. Cl.[2] ..... E01B 7/00

[58] Field of Search ..... 246/465, 415 R, 419; 104/96, 130, 131, 132, 195, 247, 246; 105/141

[56] References Cited

UNITED STATES PATENTS

| | | | |
|---|---|---|---|
| 3,356,039 | 12/1967 | Fonjen et al. | 104/130 |
| 3,552,321 | 1/1971 | Priebe | 104/130 |
| 3,672,308 | 6/1972 | Segar | 104/130 |
| 3,783,793 | 1/1974 | Perrott | 104/130 |
| 3,827,370 | 8/1974 | Hill | 104/130 |

*Primary Examiner*—M. H. Wood, Jr.
*Assistant Examiner*—Richard A. Bertsch
*Attorney, Agent, or Firm*—Newton, Hopkins & Ormsby

[57] ABSTRACT

A switch is disclosed for a railroad transporation system comprising parallel car-supporting rails defining railroad tracks which bifurcate at a switching station into two branch tracks and rotatable drive shafts which extend along a line between the parallel car-supporting rails and which also bifurcate at the switching station into first and second branch lines. The switch comprises a first car-supportable swing gate rail mounted at the switching station for movement between a position traversing the first branch line and a position aside the first branch line. A second car-supportable swing gate rail is also mounted at the switching station for movement between a position traversing the second branch line and a position aside the second branch line.

A method is also disclosed for driving a car over parallel rails through a switching station having a pivotal rail with a cam follower mounted thereto overlaying a rotatable drive shaft extending between the parallel rails and with the car having a drive wheel in rotatable driving engagement with the drive shaft and a camming surface extending from ahead of to aside of the drive wheel. The method includes the steps of rotating the rotatable drive shaft; engaging the drive wheel with the rotating drive shaft causing the car to advance over the parallel rails into engagement with the cam follower causing the pivotal rail mounted thereto and overlaying the rotating drive shaft to pivot aside of the drive shaft; and advancing the car over the rail with the drive wheel in engagement with the rotating shaft passing aside the pivotal rail.

6 Claims, 8 Drawing Figures

SWITCH FOR A RAILROAD TRANSPORTATION SYSTEM EMPLOYING A ROTATING DRIVE SHAFT

This is a division of application Ser. No. 454,446, filed Mar. 25, 1974, now U.S. Pat. No. 3,897,734.

BACKGROUND OF THE INVENTION

This invention relates generally to switches for railroad transportation systems, and particularly to switches for railroad transportation systems of the type which employ rotating drive shafts extending along railroad tracks upon which cars may be driven.

Recently, railroad transportation systems have been devised for transporting small cars or dollies in freight handling and distribution areas such as, for example, between loading docks and conveyor lines in manufacturing and processing plants. These systems may employ elongated circuitous rotatable drive shafts or tubes disposed between parallel rails as a means for propelling cars thereover. One such system is disclosed in U.S. Pat. No. 3,118,393. Here, a freely rotatable drive wheel is supported beneath a vehicle in resilient contact with the rotatable drive shaft. The drive wheel is oriented at an oblique angle with respect to the rotating drive shaft or tube whereby the drive shaft may produce a pushing force on the drive wheel which force has a component in the direction of the driving shaft and thus provides the driving force for the car. In this particular system the support means for the wheel permits the wheel to swivel and assume an orientation perpendicular to the axis of the drive shaft when the vehicle meets an obstacle and is stopped thereby. With the drive wheel positioned normally with respect to the direction of shaft extension the wheel imparts a breaking force to a moving car as the wheel skids over the rotating shafts. When the car has ceased its forward movement over the shaft, the drive wheel merely commences to rotate freely on the rotating shaft while the car remains stationary above the shaft.

In U.S. Pat. No. 3,356,040 a switch is disclosed for use with a transportation system of the type just described employing a rotating drive shaft. The disclosed switch connects two branch tracks which join together at approximately right angles in the shape of a T. A T-shaped assembly of rotating drive shafts is rotatably disposed between the rails. In order to effect a switching action a car traveling upon the tracks is brought to a stop at the T intersection and nudged laterally causing the drive wheel to more from one rotating tube to the other oriented normally thereto. The car or dolly is then driven off at 90° relative direction with respect to its initial direction without swiveling of the car itself. Instead, the switching action is sensed by the car which initiates a swiveling action of the drive wheel to orient it in proper driving relation with respect to the new axis of the rotating drive shaft onto which it has been switched.

In systems of the type just described it is virtually necessary to completely arrest forward movement of cars at switching stations in order to effect a switching action. Once the car has come to a halt, it is also necessary to urge the car onto the new tracks on order to disengage the driving wheel from the drive shaft upon which it had been propelled into the switching station into engagement with the drive shaft propelling the car out from the switch. It is further necessary to sense the switching action and in response thereto to generate and transmit a signal for the driving wheel on the car to reorient itself obliquely with respect to the axis of the subsequent drive shaft and tracks. These actions, of course, require implementing equipment together with their costs for purchase and maintenance. The fact the cars must be brought to a complete stop at each switching station required further implementing equipment and detracts from transportation speed efficiency.

Accordingly, it is a general object of the present invention to provide an improved switch for a railroad transportation system employing a rotating drive shaft.

More specifically, it is an object of the present invention to provide a switch for a railroad transportation system employing a rotating drive shaft which switch does not necessitate a change in linear velocity of a car passing through the switch.

Yet another object of the invention is to provide a switch for a railroad transportation system employing a rotating drive shaft which switch is of simple and economical construction requiring a minimum of maintenance.

Yet another object of the invention is to provide an improved method of switching cars from one track to another in railroad transportation systems employing rotating drive shafts

SUMMARY OF THE INVENTION

In one form of the invention a switch is provided for a railroad transportation system which comprises parallel car-supporting rails defining railroad tracks that bifurcate at a switching station into two branch tracks and rotatable drive shafts extending along a line between the parallel car-supporting rails and which bifurcates at the switching station into first and second branch lines. The switch includes a first car-supportable swing gate rail mounted at the switching station for movement between a position traversing the first branch line and a position aside the first branch line. A second car-supportable swing gate rail is mounted at the switching station for movement between a position traversing the second branch line and a position aside the second branch line.

In another form of the invention a method is provided for driving a car over parallel rails through a switching station having a pivotal rail with a cam follower mounted thereto overlaying a rotatable drive shaft extending between the parallel rails, and with the car having a drive wheel in rotatable driving engagement with the drive shaft in a camming surface extending from ahead of to aside of the drive wheel. The method includes the steps of rotating the rotatable drive shaft, engaging the drive wheel with the rotating drive shaft causing the car to advance over the parallel rails into the switching station, bringing the camming surface into engagement with the cam follower causing the pivotal rail mounted thereto and overlaying the rotating drive shaft to pivot aside of the drive shaft, and advancing the car over the pivotal rail with the drive wheel in engagement with the rotating shaft passing aside the pivotal rail.

DETAILED DESCRIPTION OF THE DRAWING

Figure 1:
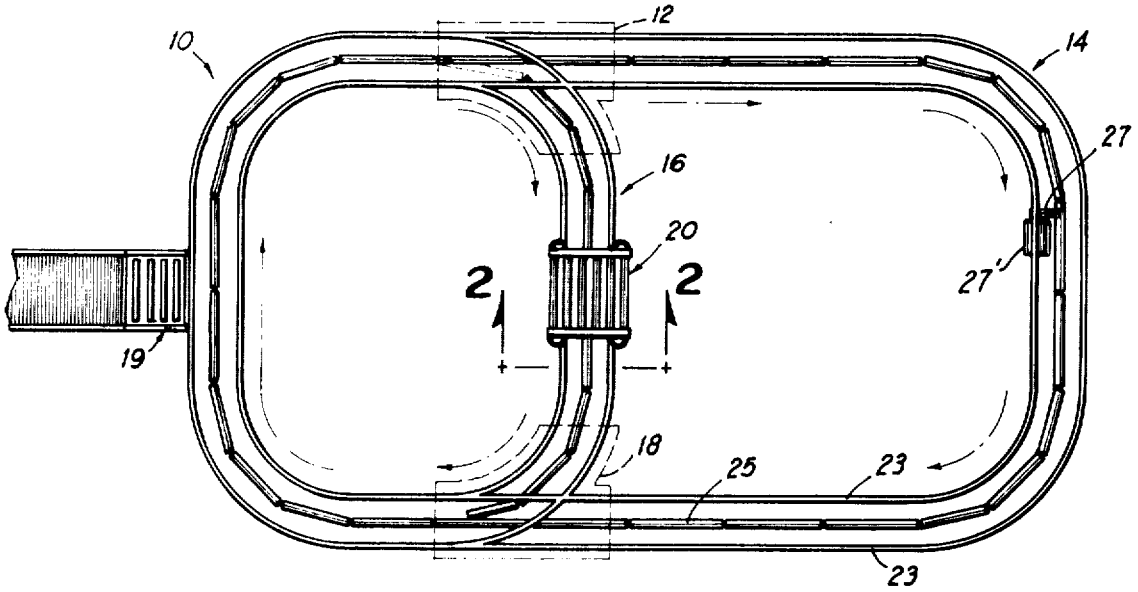
FIG. 1 is a plan view of a railroad transportation system employing a rotating drive shaft with which switches embodying principles of the present invention may be used.

Referring now in more detail to the drawing there is shown in FIG. 1 a railroad transportation system comprising tracks 10 which bifurcate at a switching station 12 into branch tracks 14 and 16 which merge at a switching station 18 back to reform tracks 10. A loading station 19 is disposed adjacent tracks 10. A dolly or car 20 is shown movably positioned upon track 16.

Figure 2:
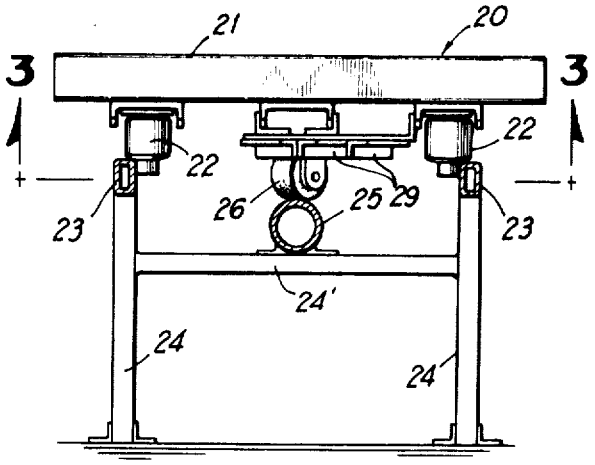
FIG. 2 is a front view in elevation of a car or dolly shown being driven over tracks of the transportation system shown in FIG. 1.
Figure 3:
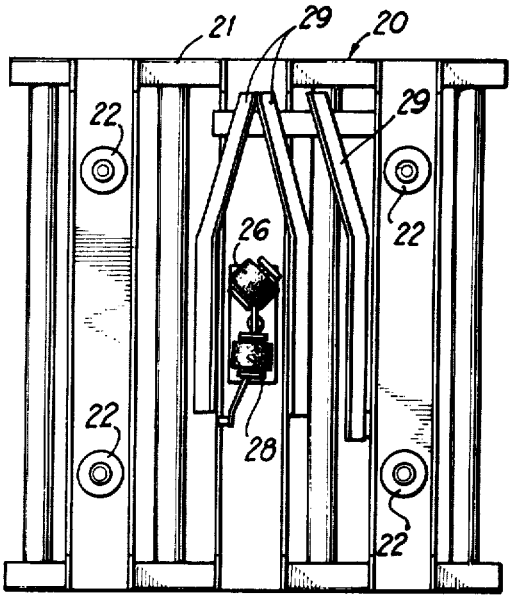
FIG. 3 is a bottom view of the car shown in FIG. 2.

In FIGS. 2 and 3 car 20 is shown in greater detail as comprising a horizontal platform 21 beneath which are rotatably mounted four support wheels 22 for rotation about axes extending normally to the plane of the tracks defined by parallel rails 23. The rails are mounted atop track supports 24 which include a horizontal support 24' upon which a drive shaft or tube 25 is rotatably mounted. A drive wheel 26 is rotatably mounted beneath platform 21 at an oblique angle with respect to drive shaft 25. A break wheel 28 is also mounted beneath the platform for rotations about an axis oriented at but a slight inclination with respect to an axis of car travel over rails 23 and that portion of drive shaft 25 disposed immediately therebeneath. Camming plates 29 are also mounted beneath platform 21 which plates extend from in front of drive wheel 26 to either side thereof.

In operation drive shaft 25, which is segmented into an elongated set of individually aligned shafts coupled together, is rotated by drive belts 27 connected with electric motor 27'. When it is desired to move a car 20 over the rails, drive wheel 26 is pivoted downwardly and brake wheel 28 simultaneously pivoted upwardly bringing the drive wheel into and the brake wheel out of frictional engagement with the rotating shaft. The force imparted by the shaft to the drive wheel forces the car forward over the tracks. When it is desired to stop the car, as for example, in front of loading station 19, the drive wheel is pivoted upwardly out of engagement with rotating shafts and the brake wheel 26 pivoted into such engagement to bring the car to a stop. The car may also be switched between branch tracks 14 and 16 switching station 12 and merge station 18 as will be further explained.

Figure 4:
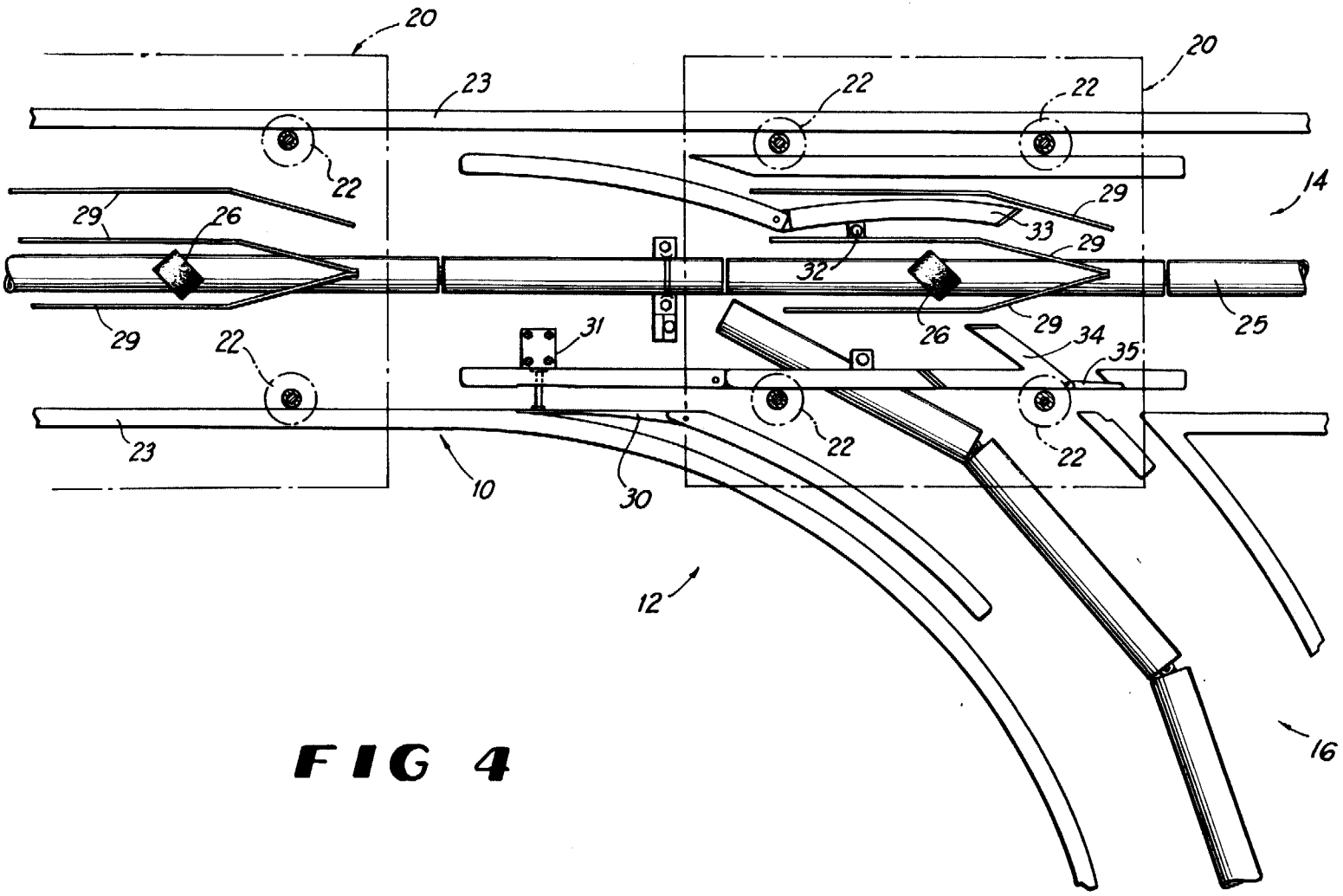
FIG. 4 is a plan view of a switch embodying principles of the present invention in one form together with a sequential view of a car passing straight through the switch.
Figure 5:
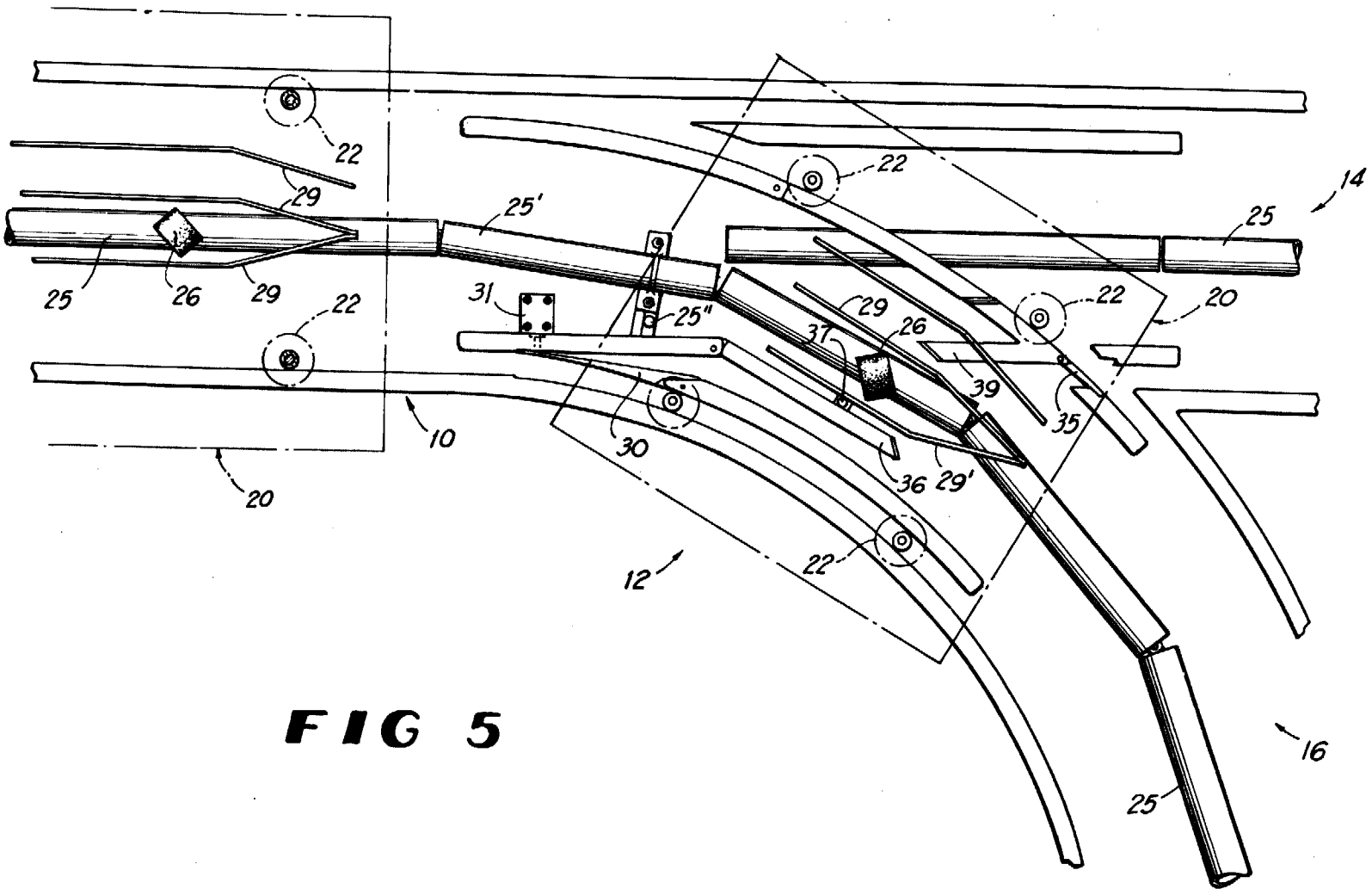
FIG. 5 is a plan view of the switch shown in FIG. 4 together with a sequential view of a car passing angularly through the switch.

Referring now to FIGS. 4 and 5 switching station 12 is seen to couple tracks 10 with branch tracks 14 and 16. FIG. 4 depicts the switch specifically oriented for the passage of a car 20 straight through the switch from tracks 10 onto branch tracks 14. For this operation a solenoid 31 is actuated to position rail flap 30 in line with branch tracks 14. With this orientation support wheels 22 of car 20 are guided straight through the switch from tracks 10 onto tracks 14. In so moving through the switch a front portion of one of camming surfaces 29 engages a cam follower 32 mounted to a swing gate rail 33 which is biased to the right as viewed in FIG. 4 into alignment with rail 34. As car 20 continues to advance through the swtich cam follower 32 will slide along the inclined side of camming surface 29 and thereby be urged to the left away from rail 34. Continued advancement of the car causes the cam follower to slide onto and along the rear portion of the camming surface 29 which is oriented substantially parallel with tracks 10 and 14. With the swing gate rail thusly opened drive wheel 26 may advance over drive shaft 25 unimpeded by the presence of the swing gate rail.

The relative position of the switch components and car in this momentary passing situation is depicted in FIG. 4 by the uppermost car 20 shown in ouline form by dashed lines. Here the drive wheel 26 is seen passing through the space normally closed by the swing gate rail 33 with car camming surface 29 urging cam follower 32 to the left. Continued movement of the car onto branch tracks 14 brings the rear portion of camming surface 29 on beyond the cam follower thereby enabling the swing gate rail to return under spring bias to its initial position in alignment with rail 34. In moving onto branch tracks 14 the right two support wheels 22 urge free pivoting flap 35 into alignment with branch tracks 14. It will be noticed that throughout the movement of the car through the switch rails support each of the four support wheels 22 both vertically and horizontally. Though the rails may be beneath either or both sides of the axis of any specific support wheel, at no time may a pair of laterally spaced wheels be free to slide laterally and thereby risk car derailment.

FIG. 5 illustrates the same switch as that shown in FIG. 4 but with an orientation for switching cars from tracks 10 onto branch tracks 16. For this operation solenoid 31 swings flap 30 to the right. Drive shaft segment 25' is also pulled to the right upon engagement of cam follower 25'' with camming surface 29'. With this orientation of switch components car 20 is guided under continuous driving force to the right onto branch tracks 16. In this process camming surface 29' also engages cam follower 37 mounted to swing gate rail 36 and urges it to the right in a similar manner as that previously described in conjunction with FIG. 4 thereby enabling drive wheel 26 to continue unimpeded by the presence of the swing gate rail through the switch. As the swing gate rail is spring biased to the left towards alignment with rail 39 it pivots back to the left and into alignment with rail 39 overlaying or traversing the line of drive shafts extending along branch tracks 16 after camming surface 29' has passed on beyond cam follower 37 as the car moves away from the switching station and onto branch tracks 16.

Figure 6:
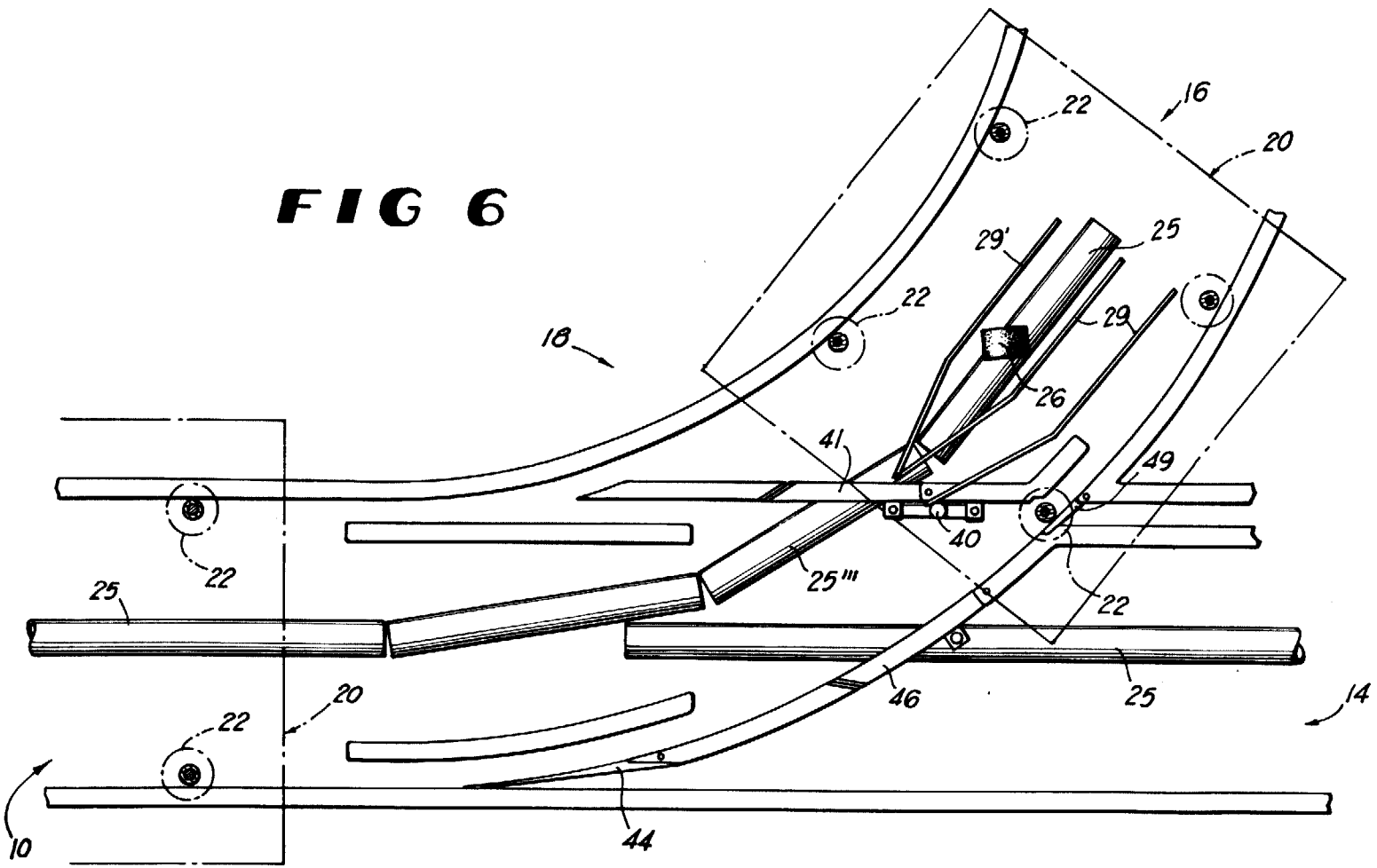
FIGS. 6 and 7 are plan views of another switch embodying principles of the invention which sequentially show a car approaching the switch and merging with a straight track.
Figure 7:
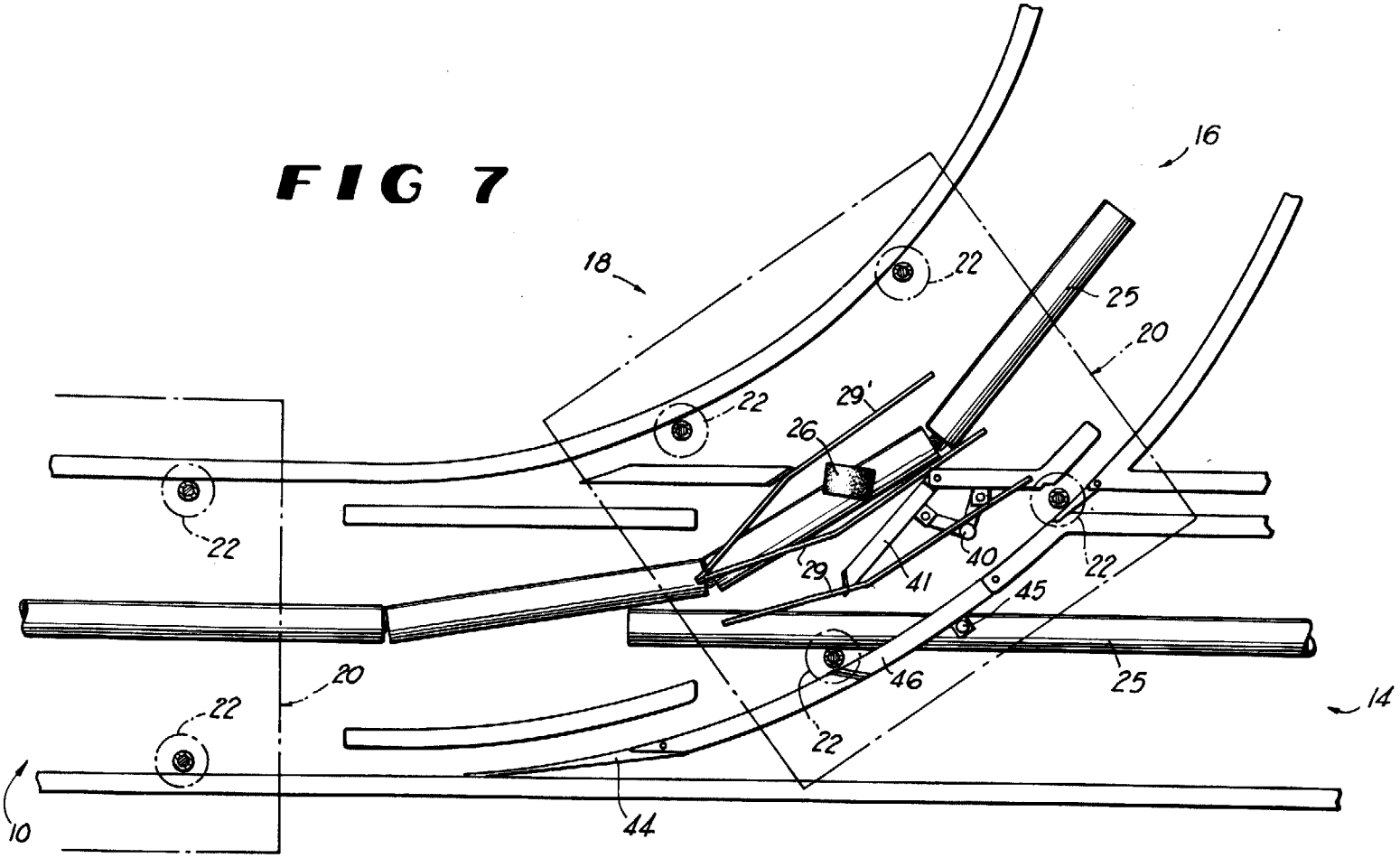
Figure 8:
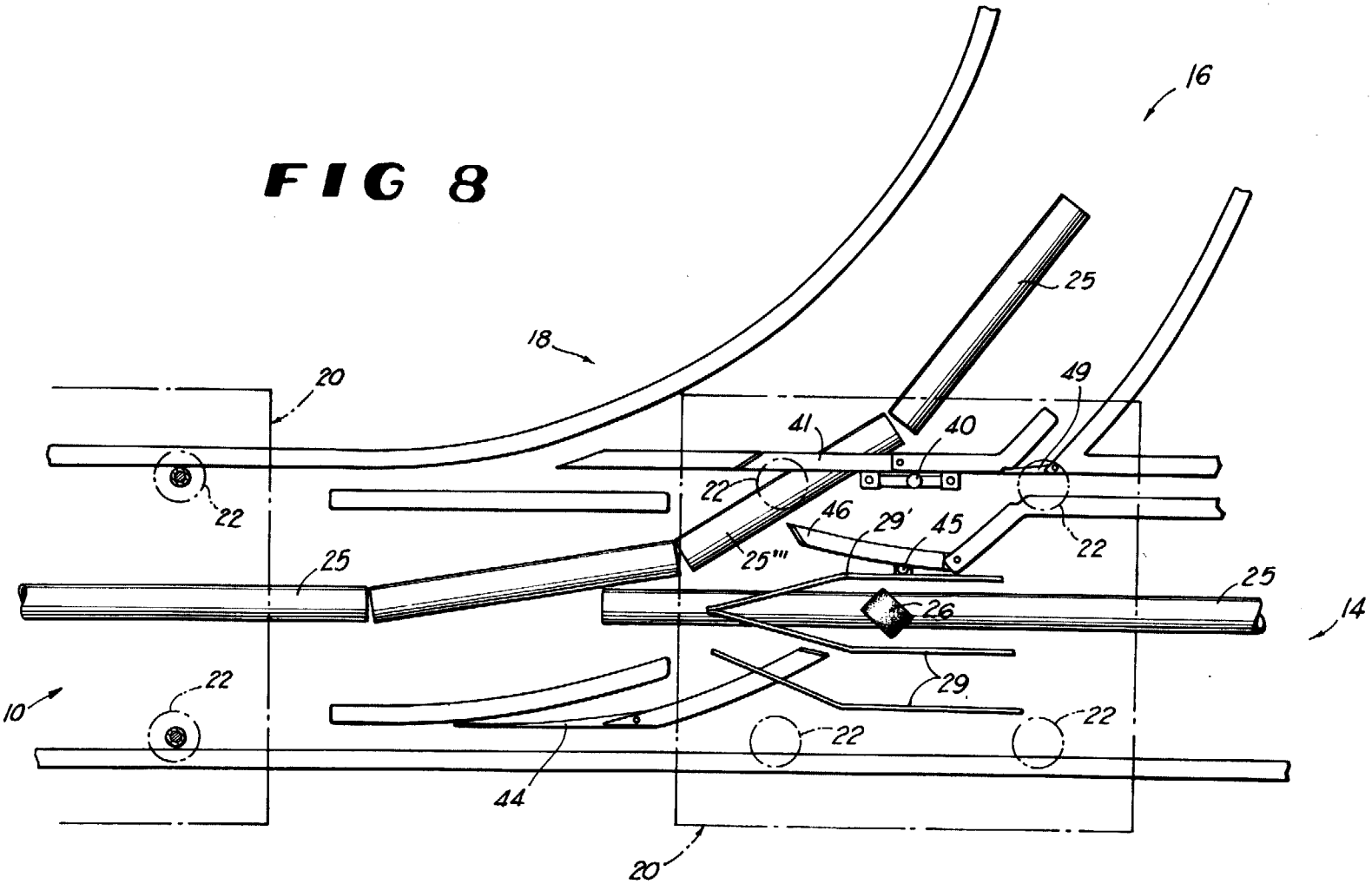
FIG. 8 is yet another plan view of the switch shown in FIGS. 6 and 7 together with a car shown passing straight through the switch.

FIGS. 6 through 8 depict another switch embodying principles of the invention which forms the merge station 18 shown in FIG. 1. In FIGS. 6 and 7 car 20 is depicted sequentially passing from branch tracks 16 onto tracks 10, whereas in FIG. 8 the car is shown passing from branch tracks 14 onto tracks 10. For the merging station the switch depicted in FIGS. 6 through 8 does not require an externally operated solenoid or other switch initiating signal or actions.

In merging from branch tracks 16 a camming surface 29 on car 20 is brought into engagement with cam follower 40 causing swing gate 41 overlaying a drive shaft segment 25''' to swing aside of this drive shaft segment from the position shown in FIG. 6 to the position shown in FIG. 7. This repositioning of the swing gate rail 41 enables drive wheel 26 to continue along the line of rotating drive shafts at the merge station unimpeded by the presence of the swing gate overlaying the branch line of rotating drive shafts. Continued progression of the car through the switch causes the active camming surface 29 to move on beyond cam follower 40 enabling the swing gate rail 41 to return under spring bias to its initial position depicted in FIG. 6 traversing drive shaft segment 25'''. This continued progression brings the car support wheels 22 onto and over free-pivoting flap rail 44 and thence out of the switch station onto tracks 10.

In FIG. 8 a car 20 is shown passing straight through the switch from branch tracks 14 onto tracks 10. In performing this operation a camming surface 29 engages cam follower 45 mounted to swing gate rail 46 urging it out from overlaying the drive shaft line branch tracks 14 aside the line. The car may thus pass through the switch without the drive wheel 26 contacting swing gate rail overlaying this line of drive shafts. In passing through the switch the car support wheels pass over two free swinging flap rails 44 and 49. As opposed to the switch shown in FIGS. 4 and 5 the switch of FIGS. 6 – 8 does not include, as an operative feature, relocation of any of the drive shaft segments themselves. Thus, in merging from tracks 14 onto tracks 10 the momentum of the car itself carries the drive wheel over the short interval of space between drive shaft segments in effecting merging.

It thus is seen that a switch is provided for a railroad transportation system employing a rotating drive shaft disposed between the parallel rails. The switch is of relatively simple and economic construction and one which does not require a change of car speed or an abrupt change of car travel direction. Many modifications may, of course, be made to the specifically described embodiments without departure from the spirit and scope of the invention as set forth in the following claims.

What is claimed is:

1. A switch for a railroad transportation system comprising parallel car supporting rails defining railroad tracks which bifurcate at a switching station into two branch tracks and switch being in combination with a car having four car supporting wheels mounted beneath said car for rotating about parallel axes extending substantially normal to the plane of said railroad tracks and a camming surface rigidly mounted beneath said car comprising a first section adjacent the front of said car extending obliquely with respect to said car wheel axes and a second section merging with said first section extending substantially parallel said car wheel axes; rotatable drive shafts extending along a line between said parallel car supporting rails and which bifurcates at said switching station into first and second branch lines; a first car supportable swing gate rail mounted at said switching station for movement between a position traversing said first branch line and a position aside said first branch line; and a second car supportable swing gate rail mounted at said switching station for movement between a position traversing said second branch line and a position aside said second branch line.

2. A switch and car combination in accordance with claim 1 further comprising a first cam follower secured to said first swing gate rail in position to be engaged by said car camming surface as said car is directed onto one of said branch tracks at said switching station over said second swing gate rail, and a second cam follower secured to said second swing gate rail in position to be engaged by said car camming surface or said car is directed onto another of said branch tracks at said switching station over said first swing gate rail.

3. A switch and car combination in accordance with claim 1 further comprising a drive wheel rotatably mounted beneath said car aside said camming surface second section.

4. A switch for a railroad transportation system comprising parallel car supporting rails defining railroad tracks which bifurcate at a switching station into two branch tracks, said switch being in combination with a car having four car supporting wheels mounted beneath said car for rotating about parallel axes extending substantially normal to the plane of said railroad tracks; rotatable drive shafts extending along a line between said parallel car supporting rails and which bifurcates at said switching station into first and second branch lines; a first car supportable swing gate rail pivotably mounted at said switching station for pivotal movement between a position traversing said first branch line and a position aside said first branch line; and a second car supportable swing gate rail pivotably mounted at said switching station for pivotal movement between a position traversing said second branch line and a position aside said second branch line.

5. A method of driving a car over parallel rails through a switching station having a pivotal rail with a cam follower mounted thereto overlaying a rotatable drive shaft extending between the parallel rails, and with the car having a drive wheel in rotatable driving engagement with the drive shaft and a camming surface extending from ahead of to aside of the drive wheel, said method including the steps of rotating the rotatable drive shaft; engaging the drive wheel with the rotating drive shaft causing the car to advance over the parallel rails into the switching station; bringing the camming surface into engagement with the cam follower causing the pivotal rail mounted thereto and overlaying the rotating drive shaft to pivot aside of the drive shaft; and advancing the car over the pivotal rail with the drive wheel in engagement with the rotating shaft passing aside the pivotal rail.

6. The method of claim 5 wherein after the drive wheel passes aside the pivotal rail the camming surface is disengaged from the cam follower and the pivotal rail is pivoted back into position overlaying the rotating drive shaft.

* * * * *